US007464811B2

(12) United States Patent
Patterson et al.

(10) Patent No.: US 7,464,811 B2
(45) **Date of Patent: *Dec. 16, 2008**

(54) MIXING CAP AND METHOD FOR USE THEREOF

(76) Inventors: Brent Patterson, 604 Ashford Pkwy., Dunwoody, GA (US) 30338; Randy Patterson, 7245 Fairbanks N. Houston, Lot #80, Houston, TX (US) 77040

( * ) Notice: Subject to any disclaimer, the term of this patent is extended or adjusted under 35 U.S.C. 154(b) by 173 days.

This patent is subject to a terminal disclaimer.

(21) Appl. No.: 11/400,907

(22) Filed: Apr. 10, 2006

(65) Prior Publication Data

US 2006/0260959 A1 Nov. 23, 2006

Related U.S. Application Data

(63) Continuation of application No. 11/115,466, filed on Apr. 27, 2005, now Pat. No. 7,055,685.

(51) Int. Cl.
*B65D 25/08* (2006.01)

(52) U.S. Cl. ..... 206/220; 206/219

(58) Field of Classification Search ..... 206/219–222, 206/568; 215/DIG. 8; 222/83, 129; 53/443; 426/66, 115, 120

See application file for complete search history.

(56) References Cited

U.S. PATENT DOCUMENTS

| | | | | |
|---|---|---|---|---|
| 3,156,369 | A | 11/1964 | Bowes et al. | |
| 4,247,001 | A * | 1/1981 | Wiegner | 206/222 |
| 4,515,267 | A | 5/1985 | Welsh | |
| 5,027,872 | A * | 7/1991 | Taylor et al. | 206/219 |
| 5,152,965 | A * | 10/1992 | Fisk et al. | 206/219 |
| 5,419,445 | A | 5/1995 | Kaesemeyer | |
| 5,433,328 | A | 7/1995 | Baron et al. | |
| 5,794,802 | A | 8/1998 | Caola | |
| 5,984,141 | A * | 11/1999 | Gibler | 206/219 |
| 6,152,296 | A | 11/2000 | Shih | |
| 6,221,416 | B1 | 4/2001 | Nohren, Jr. | |
| 6,372,270 | B1 | 4/2002 | Denny | |
| 6,527,110 | B2 | 3/2003 | Moscovitz | |
| 6,569,329 | B1 | 5/2003 | Nohren, Jr. | |
| 6,644,471 | B1 | 11/2003 | Anderson | |

(Continued)

FOREIGN PATENT DOCUMENTS

| | | |
|---|---|---|
| JP | 2003/081357 A | 3/2003 |
| JP | 2004/083022 A | 3/2004 |

*Primary Examiner*—Luan K Bui
(74) *Attorney, Agent, or Firm*—Myers & Kaplan, LLC; Ashish D. Patel

(57) ABSTRACT

A mixing cap and method for use thereof, wherein the mixing cap is preferably pre-loaded during time of manufacture with a selected dry or liquid ingredient to facilitate subsequent consumer use. The mixing cap comprises an apertured inner tube threadably-engagable to the mouth of a bottle, and an outer housing cooperatively-engaged to the inner tube and slidably-restricted thereover via a flange arrangement. Pre-loaded ingredients contained within the outer housing may be introduced or discharged into the bottle by simply depressing the outer housing over the inner tube, thereby permitting the ingredients to flow through the apertures of the inner tube and into the liquid contents of the bottle. The combined ingredients and liquid within the bottle may subsequently be shaken without fear or risk of leakage or spillage.

19 Claims, 4 Drawing Sheets

U.S. PATENT DOCUMENTS

| | | | |
|---|---|---|---|
| 6,886,686 | B2 | 5/2005 | Anderson |
| 7,055,685 | B1 | 6/2006 | Patterson et al. |
| 2002/0090426 | A1 | 7/2002 | Denny |
| 2003/0072850 | A1 | 4/2003 | Burniski |
| 2004/0200740 | A1 | 10/2004 | Cho |
| 2004/0200742 | A1 | 10/2004 | Cho |

* cited by examiner

MIXING CAP AND METHOD FOR USE THEREOF

PRIORITY CLAIM

To the fullest extent permitted by law, the present continuation patent application claims priority to, and the full benefit of, U.S. patent application Ser. No. 11/115,466, entitled "Mixing Cap and Method for Use Thereof", filed on Apr. 27, 2005, now issued as U.S. Pat No. 7,055.685.

TECHNICAL FIELD

The present invention relates generally to caps for liquid-containing bottles, and more specifically to a mixing cap for engaging the mouth of a conventional personal-sized water bottle, or other liquid-containing bottle, for enabling dry or liquid ingredients contained within the mixing cap to be conveniently deposited into the bottle, and mixed with the water or other liquid contents thereof.

BACKGROUND OF THE INVENTION

Protein powders, energy mixes, supplements, and other sports nutritional products, are frequently utilized in conjunction with regular exercise to promote a healthy lifestyle. Accordingly, consumers often purchase large containers or bulk quantities of their favorite nutritional powders or mixes, wherein many such powders or drink mixes must be combined with water or other suitable liquids to facilitate ingestion and digestion of same. However, despite the economical advantages and general long-term product supply afforded by such bulk purchases, the impracticalities and inconveniencies associated with the use of such large containers of powders or mixes, in view of preferred consumer use, present noticeable disadvantages.

Specifically, many individuals utilize public gyms or fitness centers, wherein immediately following an exercise session, many such individuals prefer to ingest a favorite powdered sports drink for optimal bodily absorption. Accordingly, these individuals are often forced to inconveniently tote the large containers of powder to their fitness center for subsequent use, or pre-bag or pre-package smaller portions thereof prior to leaving home.

Additionally, because such powders must be combined with a liquid, consumers must undertake the time-consuming and often messy process of properly combining and mixing the powder with a glass or bottle of water. That is, when utilizing a glass, or other wide-mouthed container, of water, the consumer must measure and deposit the appropriate amount of sports powder within the glass and, thereafter, shake, stir or otherwise fully mix the combined dry and liquid contents. In doing so, powder and/or powder-liquid mix often spills from the wide mouth of the glass, resulting not only in mess and partial loss of product, but a potentially significant reduction in the manufacturer's recommended serving size. This latter disadvantage becomes particularly problematic when the consumer has painstakingly pre-measured and bagged or packed a limited amount of sports powder for use at his/her fitness center, leaving the much larger container of sports powder at his/her residence.

To avoid the spillage problems associated with mixing powdered sports drinks in wide-mouthed containers of water, many consumers will utilize a conventional personal-sized bottle of water, which typically have a relatively diametrically smaller mouth. In use, the bottle cap is treadably engaged to the bottle mouth following deposit of the sports powder therethrough; thus, enabling rapid and forcefully shaking and uniform mixture of the powder-water contents of the bottle, without risk of leakage or spillage of same. However, in utilizing such water bottles alone, consumers must attempt to feed or funnel the powder through the relatively narrow mouth of the bottle, which, more often than not, results in spillage of the sports powder.

As such, in an attempt to overcome the disadvantages associated with the foregoing system of powdered sports drink preparation, many available devices provide for a mixing cap engageable to a liquid container, wherein the mixing cap enables introduction of a dry or liquid ingredient into the communicating bottle for mixture with the liquid contents thereof. Examples of such devices may be seen with reference to U.S. Patent Publication No. 2004/0200742A1 to Cho; U.S. Patent Publication No. 2004/0200740A1 to Cho; U.S. Patent Publication No. 2003/0072850 A1 to Burniski; U.S. Patent Publication No. 2002/0090426 A1 to Denny; U.S. Pat. No. 6,569,329 B1 to Nohren, Jr.; U.S. Pat. No. 6,372,270 B1 to Denny; U.S. Pat. No. 6,221,416 B1 to Nohren, Jr.; U.S. Pat. No. 6,152,296 to Shih; U.S. Pat. No. 5,984,141 to Gibler; U.S. Pat. No. 5,794,802 to Caola; U.S. Pat. No. 5,433,328 to Baron et al.; and, U.S. Pat. No. 5,419,445 to Kaesemeyer. However, the foregoing references teach devices possessing structural and functional features and limitations, which, in addition to being unnecessarily complex, render use of the device largely inconvenient.

For example U.S. Pat. No. 5,984,141 to Gibler (Gibler '141) discloses a beverage storage and mixing device comprising a cap assembly attached to a conventional drink bottle, wherein the cap assembly comprises an inner cylindrical housing rotatably nested within an outer cylindrical housing. In use, apertures formed through the inner and outer housings must be properly aligned to effectively enable liquid contained within the cap to be dispensed into the communicating bottle. The cap assembly of Gibler '141 further requires the rupturing of a bottom wall for full introduction and mixing of the liquid from the cap assembly with the liquid contents of the communicating bottle.

U.S. Pat. No. 5,443,328 to Baron et al. (Baron '328) teaches a baby bottle comprising a storage container for holding food material, wherein the storage container is adapted to fit between the tubular mouth of a baby bottle and a nipple-supporting end cap of the baby bottle. The bottle further comprises a release mechanism coupled to the mouth of the baby bottle for controlling access to the food material contained in the storage container body by water stored in the baby bottle. To operate the release mechanism, the nipple-supporting end cap is pulled upwards to dislodge a stopper from an aperture in the release mechanism, thereby enabling access to the food material by the water upon shaking the baby bottle. However, not only is the Baron '328 device structurally-limited to standard baby bottles, which traditionally have wide mouths, the device would not effectively prevent spillage or spray of the food material and water from the nipple of the end cap during the shaking process; thus, resulting in mess and, even with use of a nipple cover or cap, partial loss of product.

U.S. Patent Application Publication No. 2004/0200740 to Cho (Cho '740) discloses a cap device and bottle, whereupon rotating the cap device relative to the bottle enables mixing of an additive contained within the cap with a material contained within the communicating bottle. That is, a valve unit is threadably-engaged with an additive-containing unit, wherein the valve unit is engaged, threadably or via frictional-fit, to the mouth of a bottle. Unthreading of the additive-containing unit from the valve unit disengages a stopper carried by the valve unit from an aperture formed in the additive-containing unit, thus enabling the additive to enter the communicating bottle. However, in addition to the inconvenience associated with the Cho '740 multi-step process of having to threadably engage the valve unit with the additive-containing unit, and then the valve unit with a bottle, and, thereafter, unthread the additive-containing unit from the valve unit to enable introduction of the additive to the bottle contents, the structural design of Cho '740 is further flawed, as the user may inadvertently completely unthread and remove the additive-containing unit from the valve unit and, thus, release or spill the additive therefrom. Even if not fully unthreaded, an insufficient number of engaged threads between the additive-containing unit and the valve unit will result in a weak seal or engagement and, thus, ineffectively prevent leakage of the additive-liquid mix from the cap device during the shaking and mixing process.

Therefore, it is readily apparent that there is a need for a mixing cap and method for use thereof, wherein the mixing cap engages the mouth of a conventional personal-sized water bottle, or other liquid-containing bottle, and wherein simply depressing the mixing cap enables dry or liquid ingredients contained within the mixing cap (i.e., loaded during time of manufacture, or initial consumer use) to be expeditiously and conveniently deposited into the bottle, and whereupon shaking the bottle effectively intermixes the water or other liquid contents thereof with the added ingredient, without risk of spillage or leakage of the mixture therefrom.

BRIEF SUMMARY OF THE INVENTION

Briefly described, in a preferred embodiment, the present invention overcomes the above-mentioned disadvantages, and meets the recognized need for such a device by providing a mixing cap and method for use thereof, wherein the mixing cap is preferably pre-loaded during time of manufacture with a selected dry or liquid ingredient to facilitate subsequent consumer use. The mixing cap comprises an apertured inner tube threadably-engagable to the mouth of a bottle, and an outer housing cooperatively-engaged to the inner tube and slidably-restricted thereover via a flange arrangement. Pre-loaded ingredients contained within the outer housing may be introduced or discharged into the bottle by simply depressing the outer housing over the inner tube, thereby permitting the ingredients to flow through the apertures of the inner tube and into the liquid contents of the bottle. The combined ingredients and liquid within the bottle may subsequently be shaken without fear or risk of leakage or spillage.

According to its major aspects and broadly stated, the present invention in its preferred form is a mixing cap and method for use thereof, wherein the mixing cap generally preferably comprises an apertured inner tube, an outer housing, and flange arrangements integrally formed therewith. The outer housing is preferably pre-loaded during time of manufacture with a selected dry or liquid ingredient to facilitate subsequent consumer use; however, it is contemplated that the outer housing may be loaded with a selected ingredient at time of initial consumer use (i.e., post-manufacture). The present mixing cap is preferably threadably-engageable to the mouth of a conventional personal-sized water bottle or other liquid-containing bottle; however, it should be recognized that the technology of the present invention may be appropriately modified to accommodate the various structural properties of a selected bottle, including, without limitation, mouth diameter, flanged mouths, threaded or unthreaded mouths, and/or the like.

More specifically, the present invention is a mixing cap and method for use thereof, wherein the mixing cap preferably comprises a pre-loaded outer housing cooperatively-engaged to an inner tube, and wherein the inner tube is preferably threadably-engagable to the mouth of a bottle. The outer housing preferably comprises a storage receptacle in communication with a tapered neck portion, through which the inner tube extends. The inner tube preferably comprises a peaked or dome-shaped top wall in communication with a hollow, cylindrical-shaped sidewall, wherein the sidewall preferably comprises a plurality of apertures formed therethrough, proximate the top wall. Slidable movement of the outer housing over the inner tube is preferably restricted via a series of flanges externally disposed around the inner tube and engageable with internally and externally disposed flanges carried by the outer housing. The general flange arrangement of the mixing cap further provides an effective sealing means during use of the present invention.

When the mixing cap is in a "closed position", the pre-loaded ingredients or contents are maintained within the storage receptacle of the outer housing by virtue of the dome-shaped top wall of the inner tube functioning as an effective seal between the storage receptacle and neck portion of the outer housing. Additionally, in such a closed position, the apertures of the inner tube are disposed against and covered by the inner wall of the neck portion of the outer housing.

As such, to place the mixing cap into an "open position", so that the contents of the outer housing may be introduced or discharged into the communicating bottle, the outer housing is sufficiently depressed or forcefully pushed to downwardly slide the neck portion of the outer housing over the inner tube, wherein such downward pushing results in an exteriorly-disposed flange of the inner tube overcoming and passing over an internally-disposed flange of the outer housing. In such a configuration, the apertured portion of the inner tube is introduced into the storage receptacle of the outer housing; thus, enabling the contents thereof to flow through the sidewall apertures of the inner tube and into the liquid contents of the bottle. Preferably, the dome-shaped top wall of the inner tube facilitates such flow, and prevents settling or accumulation of the contents thereon. The combined ingredients and liquid within the bottle may subsequently be shaken without fear or risk of leakage or spillage. Following the shaking process, removal of the mixing cap enables consumption of the fully mixed beverage.

Accordingly, a feature and advantage of the present invention is its ability to facilitate the introduction of a dry/liquid ingredient into a bottle, without risk of spillage of the ingredient.

Another feature and advantage of the present invention is its ability to facilitate the mixing of a dry/liquid ingredient with the contents of a bottle, without risk of spillage of the ingredient or bottle contents.

Still another feature and advantage of the present invention is its ability to provide a preloaded mixing cap.

Yet another feature and advantage of the present invention is its ability to provide a mixing cap that may be loaded at time of initial consumer use.

Still yet another feature and advantage of the present invention is its ability to provide a mixing cap, the contents of which may be introduced or discharged into a bottle by simply depressing the mixing cap.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

Figure 1:
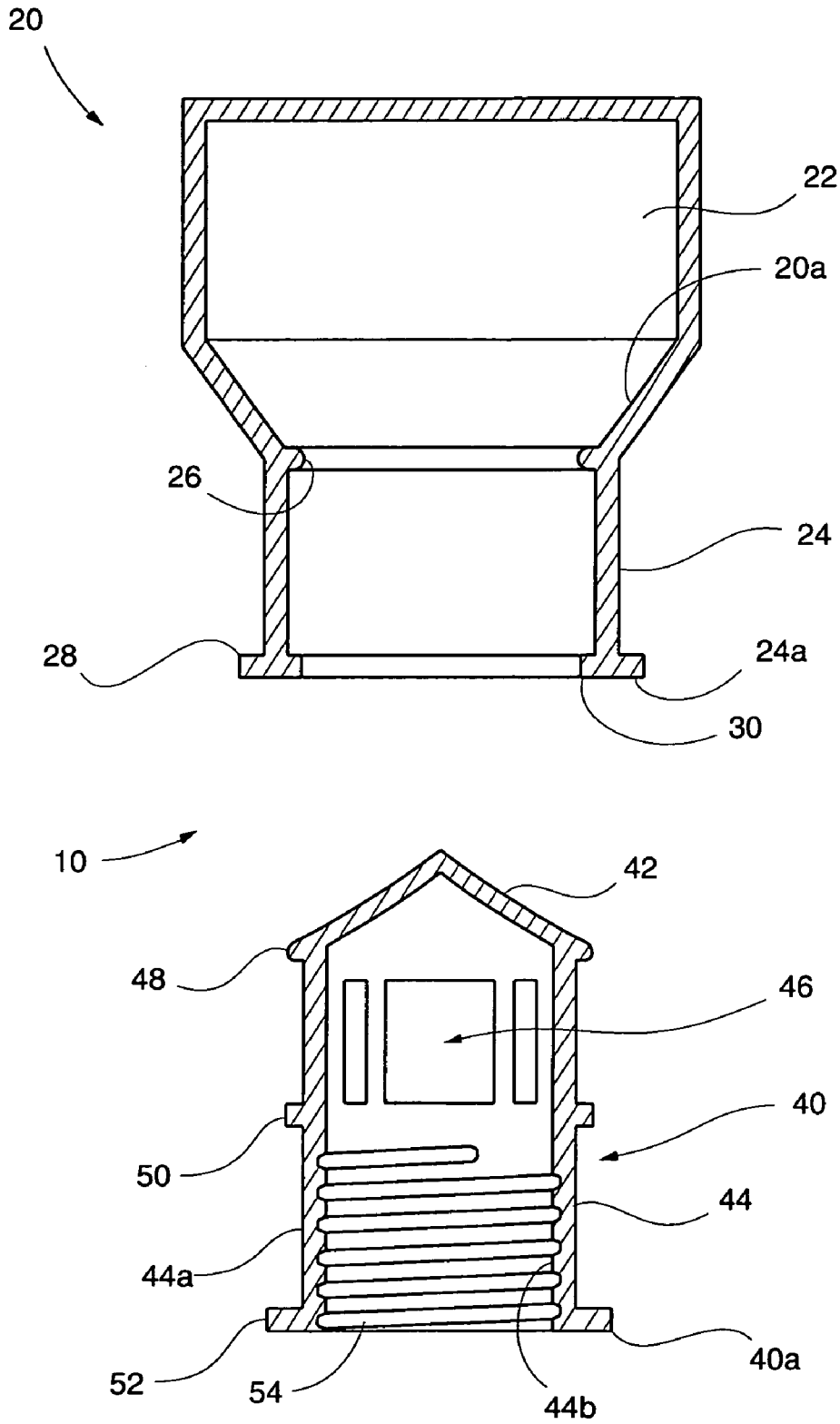
FIG. 1 is a cross-sectional exploded side view of a mixing cap according to a preferred embodiment of the present invention.

In describing the preferred and alternate embodiments of the present invention, as illustrated in FIGS. 1-4, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIG. 1-4, the present invention in its preferred embodiment is a mixing cap 10 and method for use thereof, wherein mixing cap 10 preferable comprises outer housing 20 and inner tube 40. Mixing cap 10 is preferably formed from a suitable plastic substrate, such as, for exemplary purposes only, polyethyleneterephalate (PET), and with sufficient structural rigidity to prevent deformation, breakage and/or tearing of same during implementation of the present method. Accordingly, outer housing 20 and inner tube 40 and are preferably formed via blow molding processes, injection molding processes, or the like. Additionally, during time of manufacture, and preferably prior to assembly, of mixing cap 10, outer housing 20 is pre-loaded with a selected dry or liquid ingredient to facilitate subsequent consumer use; however, and as more fully described below, it is contemplated that outer housing 20 may be loaded with a selected ingredient at time of initial consumer use (i.e., post-manufacture). It should be recognized that other suitable materials or substrates may be utilized to form mixing cap 10, such as, for exemplary purposes only, metals, metal alloys, ceramics, or the like Referring now more specifically to FIG. 1, outer housing 20 preferably comprises a substantially bulb-shaped configuration defined by upper storage receptacle 22 and lower tapered neck portion 24, wherein storage receptacle 22 contains the selected dry or liquid ingredient for introduction into, and mixture with, the contents of a bottle, as more fully described below.

Preferably formed on and around inner wall 20*a* of outer housing 20, between storage receptacle 22 and neck portion 24 thereof, is rounded inner medial flange 26. Additionally, preferably disposed on and around base 24*a* of neck portion 24 is outer base flange 28, wherein an inner base flange 30 is disposed on and around inner wall 20*a* of outer housing 20, directly behind or opposite outer base flange 28. As more fully described below, flanges 26, 28, 30 preferably interact with a flange arrangement formed over inner tube 20 and, thus, operatively control and restrict slidable interaction between outer housing 20 and inner tube 40.

Figure 4:
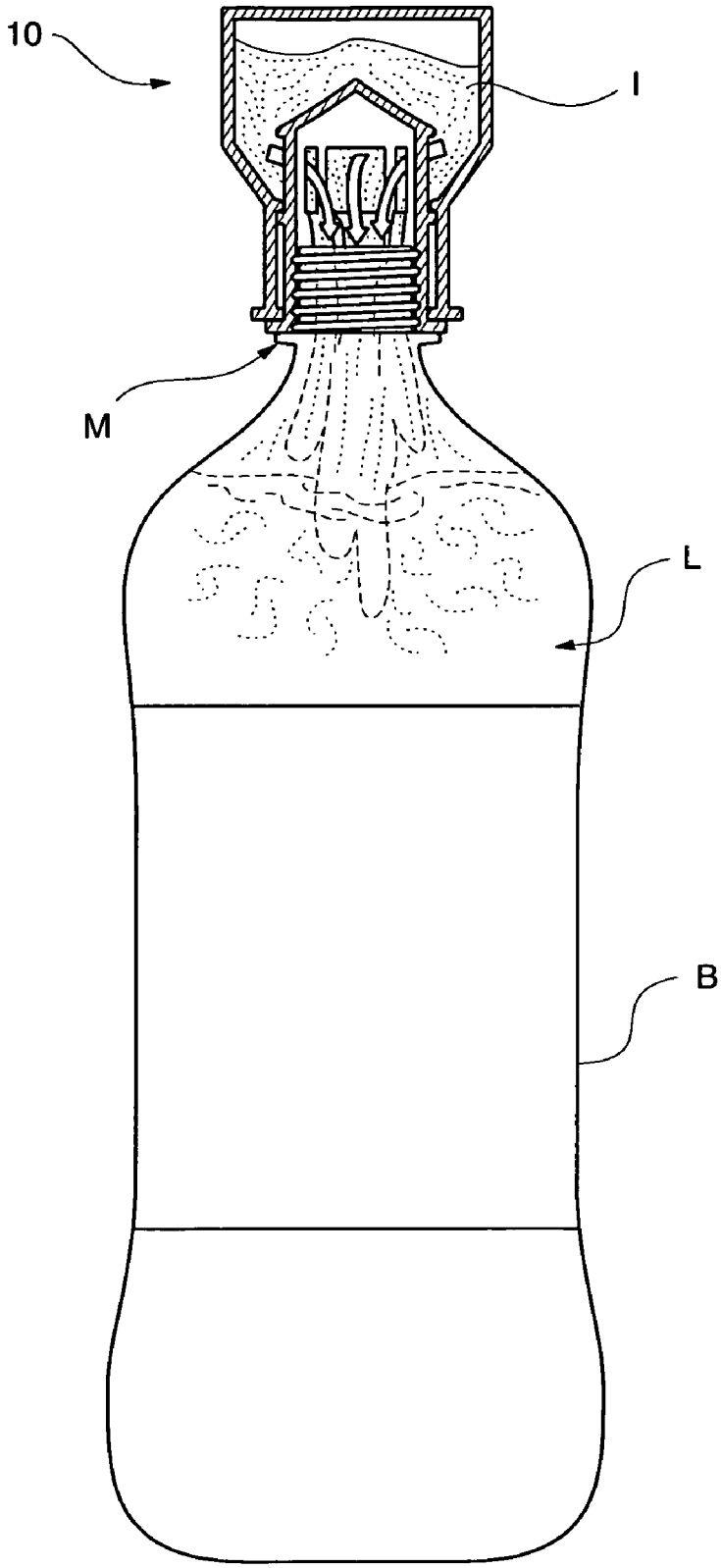

Inner tube 40 preferably comprises peaked or dome-shaped top wall 42 integrally formed with hollow, cylindrical-shaped sidewall 44, wherein sidewall 44 preferably comprises apertures 46 formed therethrough, proximate top wall 42. Preferably formed on and around exterior surface 44*a* of sidewall 44 is rounded upper flange 48, disposed proximate top wall 42; medial flange 50, disposed proximate apertures 46; and, base flange 52, disposed at base 40*a* of inner tube 40. Additionally, preferably formed on lower inner surface 44*b* of sidewall 44 is threading 54, wherein threading 54 preferably enables inner tube 40, and mixing cap 10 generally, to be threadably-engaged to mouth M of conventional personal-sized water bottle B or other liquid-containing bottle, as best illustrated in FIG. 4. Although, mixing cap 10 is preferably threadably-engaged to mouth M of bottle B, it should be recognized that the technology of the present invention may be appropriately modified to accommodate the various structural properties of any selected bottle, including, without limitation, mouth diameter, flanged mouths, threaded or unthreaded mouths, and/or the like. As such, it is contemplated that mixing cap 10 may be coupled to an unthreaded mouth of a bottle via frictional-fit.

Figure 2:
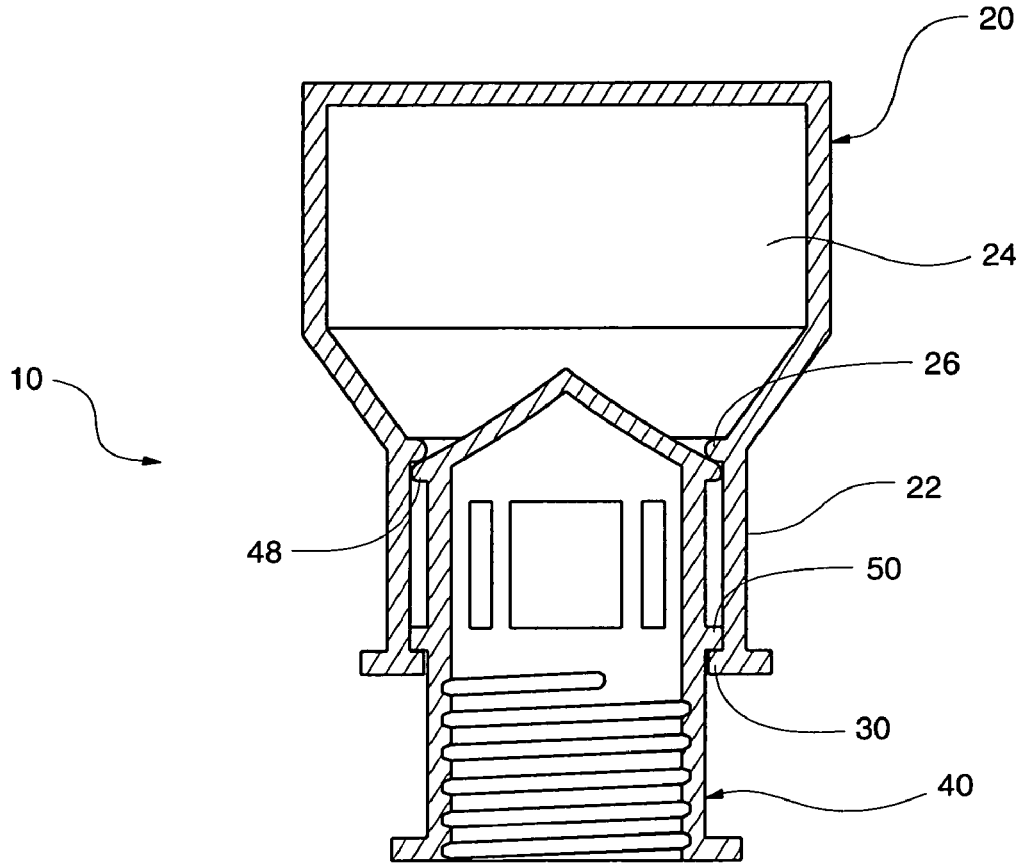
FIG. 2 is cross-sectional side view of a mixing cap according to a preferred embodiment of the present invention, shown in a closed or inactivated position.

Referring now more specifically to FIG. 2, with continued reference to FIG. 1, when mixing cap 10 is in an assembled configuration, outer housing 20 is preferably cooperatively engaged to inner tube 40, wherein slidable movement of outer housing 20 over inner tube 40 is preferably initially controlled and restricted via interaction between flanges 26, 28, 30 of outer housing 20 and flanges 48, 50, 52 of inner tube 40.

Specifically, when mixing cap 10 is in a "closed position", the preloaded ingredients or contents are maintained within storage receptacle 22 of outer housing 20 by virtue of dome-shaped top wall 42 of inner tube 40 functioning as an effective seal between storage receptacle 22 and neck portion 24 of outer housing 20. In such a configuration, upper flange 48 of inner tube 40 is preferably positioned below and bears against inner medial flange 26 of outer housing 20, wherein medial flange 50 of inner tube 40 is seat on inner base flange 30 of outer housing 20. Additionally, in such a closed position, apertures 46 of sidewall 44 of inner tube 40 are preferably disposed against and covered by inner wall 20*a* of neck portion 24 of outer housing 20.

Figure 3:
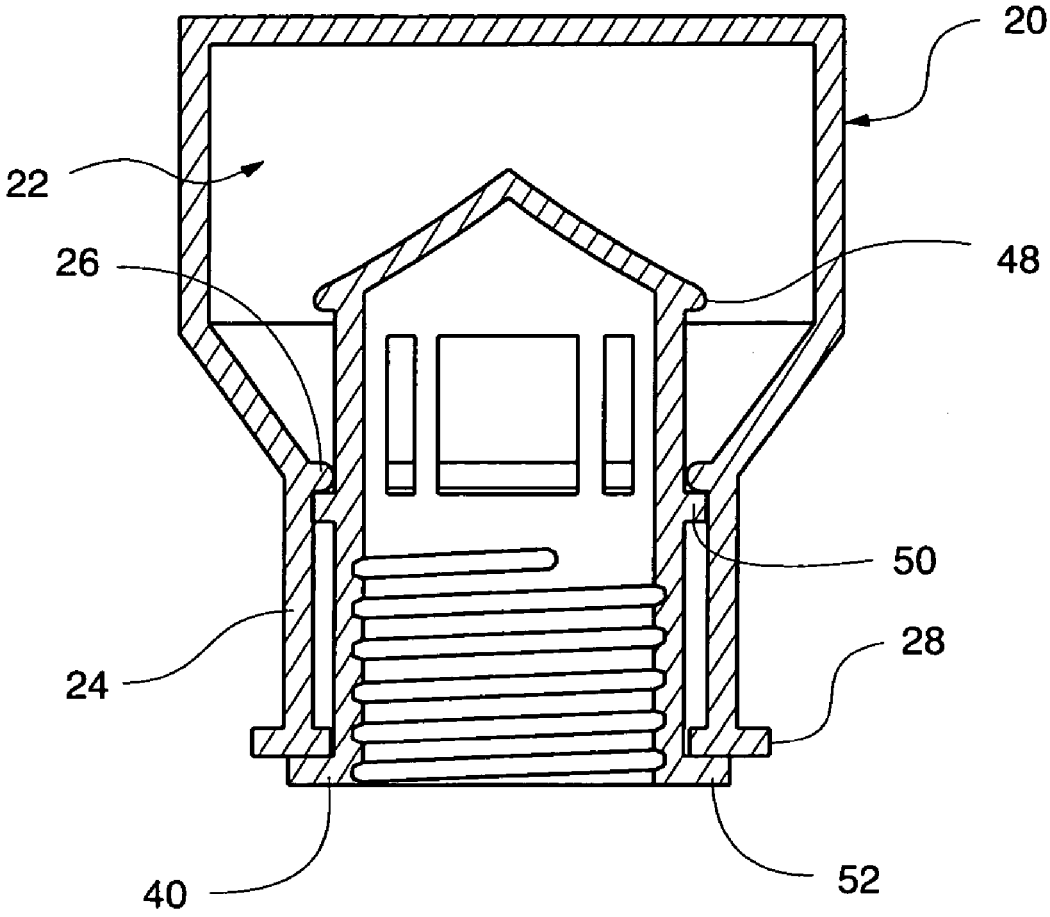
FIG. 3 is cross-sectional side view of a mixing cap according to a preferred embodiment of the present invention, shown in an open or activated position; and, FIG. 4 is partial cross-sectional side view of a mixing cap according to a preferred embodiment of the present invention, shown in use.

Referring now more specifically to FIGS. 3-4, with continued reference to FIGS. 1-2, to place mixing cap 10 into an "open position", so that dry/liquid ingredients I of storage receptacle 22 of outer housing 20 may be introduced or discharged into communicating bottle B, outer housing 20 is sufficiently depressed or forcefully pushed to downwardly slide neck portion 24 thereof over sidewall 44 of inner tube 40. Such downward pushing of outer housing 20 results in rounded upper flange 48 of inner tube 40 overcoming and passing over rounded inner medial flange 26 of outer housing 20, and further brings medial flange 50 of inner tube 40 below and in contact with inner medial flange 26, and outer flange 28 of outer housing 20 in contact with base flange 52 of inner tube 40; thereby, precluding or restricting further slidable movement of outer housing 20 over inner tube 40, generally. It should be noted that the rounded edge of upper flange 48 of inner tube 40 and inner medial flange 26 of outer housing 20 function to effectively facilitate passage of upper flange 48 over inner medial flange 26, as described above, and further facilitate the flow or passage of dry/liquid ingredients I thereover and therepast when mixing cap 10 is placed into an "open position."

In such an open configuration, apertures 46 of sidewall 44 of inner tube 40 are introduced into storage receptacle 22 of outer housing 20; thus, enabling ingredients I of outer housing 20 to flow through apertures 46, and generally through inner tube 40, and into the liquid contents L of bottle B. Preferably, dome-shaped top wall 42 of inner tube 40 facilitates such flow, and prevents settling or accumulation of ingredients I thereon. The combined ingredients I and liquid L within bottle B may subsequently be shaken without fear or risk of leakage or spillage. Following the shaking process, removal of mixing cap 10 enables consumption of the fully mixed beverage.

It should be noted that the general arrangement of, and interaction between, flanges 26, 28, 30 of outer housing 20 and flanges 48, 50, 52 of inner tube 40 provide an effective sealing means during use of the present invention, and particularly during the shaking process hereof.

As is best illustrated in FIG. 3, outer flange 28 of outer housing 20 is dimensioned such that it extends past base flange 52 of inner tube 40; that is, outer flange 28 of outer housing 20 is preferably diametrically larger than base flange 52 of inner tube 40. As such, when mixing cap 10 is disposed in an open position, and following the shaking process as described above, a user may opt to grasp outer flange 28 of outer housing 20, pulling upward thereon and, thus, revert mixing cap 10 into a closed position (as described above) prior to removing mixing cap 10 from mouth M of bottle B; thereby trapping any residual droplets of ingredient/liquid mixture within storage receptacle 22.

Although outer housing 20 is preferably preloaded with ingredient I during time of manufacture of mixing cap 10, it is contemplated in an alternate embodiment that mixing cap 10 may be loaded at time of initial consumer use. In such a process, the consumer could simply remove inner tube 40 from outer housing 20; utilize outer housing 20 as a "scoop" within a larger container of ingredient I and, thus, scoop a desired quantity of ingredient I therewithin; and, replace inner tube 40 within neck portion 24 of outer housing 20 in a closed position (as described above). Alternatively, if the particle size and consistency of dry ingredient I permits, inner tube 40 may be pushed into an open position (as described above), and the ingredient I may be introduced directly though inner tube 40, and through apertures 46 thereof, for subsequent deposit within storage receptacle 22 of outer housing 20. Indeed, this latter process may be conveniently utilized where the selected ingredient I is a liquid or other similar composition of suitable viscosity.

It is contemplated in another alternate embodiment that storage receptacle 22 of outer housing 20 may be manufactured in any selected volumetric size so as to provide a variety of preloaded, or loadable, mixing caps 10 adapted to facilitate the ingestion or consumption of accurately measured quantities of ingredient I.

It is contemplated in still another alternate embodiment that preloaded outer housing 20 could comprise a rupturable or pealable seal disposed over base 24*a* of neck portion 24. In such an embodiment, the seal could be appropriately ruptured or pealed off, wherein inner tube 40 could be subsequently inserted through neck potion 24 of outer housing 20, in a closed position (as described above).

It is contemplated in yet another alternate embodiment that preloaded outer housing 20 could comprise a rigid seal disposed between storage receptacle 22 and neck portion 24, with inner tube 40 nested within neck portion 24 of outer housing as described above. In such an embodiment, depressing outer housing 20 would effectively cause inner tube 40 to push against the rigid seal and dislodge same from its position within outer housing 20; thus enabling mixture of preloaded ingredients I with the contents of bottle B. The foregoing embodiment may alternatively utilize a rupturable seal.

It is contemplated in still another alternate embodiment that dome-shaped top wall 42 of inner tube 40 could comprise fins or ribs (i.e., linear, curved or spiral shaped fins) integrally formed thereover to facilitate agitation of the ingredients I with the contents of bottle B.

Although the present invention contemplates use of mixing cap 10 for powdered sports drinks, supplements and the like, it should be recognized that mixing cap 10, or any dimensional variation thereof, may be utilized to facilitate the introduction and mixture of any selected ingredient, additive or the like to the contents of a communicating bottle or container. As such, the present invention may be utilized to mix concentrated beverage powders with water (ex., CRYSTAL LIGHT and KOOL-AID drink powders), gels with suitable liquids, salad dressings, baby formulas, medicines, chemicals, oils, or the like.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A mixing cap for engaging a bottle, said mixing cap comprising:

an inner tube comprising a top wall and an exteriorly-disposed flange on said inner tube; and, an outer housing, said outer housing cooperatively-engaged with said inner tube and comprising an internally-disposed flange, wherein contents contained within said outer housing are introduced through said inner tube and into the bottle by depressing said outer housing over said inner tube, wherein said top wall is positioned between a storage receptacle and a neck portion of said outer housing when said mixing cap is in a closed position, and wherein said internally-disposed flange contacts said exteriorly-disposed flanged formed on said inner tube when said mixing cap is in a closed position.

2. The mixing cap of claim 1, wherein said inner tube is engageable to the bottle.

3. The mixing cap of claim 1, wherein said inner tube comprises a sidewall, said sidewall comprising at least one aperture formed therethrough.

4. The mixing cap of claim 1, wherein said inner tube is disposed within said neck portion.

5. The mixing cap of claim 3, wherein said at least one aperture of said inner tube is covered by said neck portion of said outer housing when said mixing cap is in a closed position.

6. The mixing cap of claim 1, wherein said mixing cap is placed into an open position when said outer housing is depressed to pass over said inner tube.

7. The mixing cap of claim 1, wherein said exteriorly-disposed flanged of said inner tube overcomes and passes over said internally-disposed flange of said outer housing when said outer housing is depressed to pass over said inner tube.

8. The mixing cap of claim 4, wherein said at least one aperture of said inner tube is positioned within said storage receptacle of said outer housing and, thus, exposed to the contents stored therein, when said outer housing has been depressed to pass over said inner tube.

9. The mixing cap of claim 4, wherein said at least one aperture of said inner tube enables the contents of said storage receptacle to flow therethrough and into the bottle for mixing or shaking with contents disposed within the bottle.

10. The mixing cap of claim 1, wherein said top wall of said inner tube is dome-shaped to facilitate flow of the contents thereover, and to prevent settling of contents thereon, when said outer housing is depressed to pass over said inner tube.

11. The mixing cap of claim 1, wherein said outer housing and said inner tube each comprises a flange arrangements that restrict the range of slidable movement of said outer housing over said inner tube.

12. A mixing cap for introducing contents carried therewithin into a communicating bottle, said mixing cap comprising:

an inner tube comprising an apertured sidewall and an exteriorly-disposed flange formed on said inner tube; and, an outer housing comprising a storage receptacle, a neck portion, and an internally-disposed flange, wherein said inner tube is disposed within said neck portion, wherein the contents contained within said storage receptacle of said outer housing are introduced through said apertured sidewall of said inner tube and into the bottle by depressing said outer housing over said inner tube, and, wherein said internally-disposed flange of said outer housing contacts said exteriorly-disposed flange of said inner tube when said mixing cap is in a closed position and wherein said internally-disposed flange and said exteriorly-disposed flange restrict the range of slidable movement of said outer housing over said inner tube.

13. The mixing cap of claim 12, wherein said apertured sidewall of said inner tube is covered by said neck portion of said outer housing when said mixing cap is in a closed position.

14. The mixing cap of claim 12, wherein said inner tube comprises a top wall, said top wall positioned between said storage receptacle and said neck portion of said outer housing when said mixing cap is in a closed position.

15. The mixing cap of claim 12, wherein said mixing cap is placed into an open position when said outer housing is depressed to pass over said inner tube.

16. The mixing cap of claim 12, wherein said exteriorly-disposed flanged of said inner tube overcomes and passes over said internally-disposed flange of said outer housing when said outer housing is depressed to pass over said inner tube.

17. The mixing cap of claim 12, wherein said apertured sidewall of said inner tube is positioned within said storage receptacle of said outer housing and, thus, exposed to the contents stored therein, when said outer housing has been depressed to pass over said inner tube.

18. The mixing cap of claim 12, wherein said apertured sidewall of said inner tube enables the contents of said storage receptacle to flow therethrough and into the bottle for mixing or shaking with liquid disposed within the bottle.

19. A method for introducing a selected ingredient into a bottle, said method comprising the steps of:

utilizing a mixing cap, said mixing cap comprising an apertured inner tube having an exteriorly-disposed flange and a top wall, and an outer housing having a storage receptacle, a neck portion, and an internally disposed flange, said outer housing cooperatively-engaged with said inner tube and said internally-disposed flange contacting said exteriorly-disposed flanged and said top wall being positioned between said storage receptacle and said neck portion when said mixing cap is in a closed position; and, depressing said outer housing over said inner tube wherein contents contained within said outer housing are introduced through an aperture of said apertured inner tube and into the bottle.

* * * * *